United States Patent [19]

Mardirossian

[11] 4,288,892

[45] Sep. 15, 1981

[54] BUCKLE

[75] Inventor: John H. Mardirossian, Warwick, R.I.

[73] Assignee: Paul Levinger, Providence, R.I.

[21] Appl. No.: 970,549

[22] Filed: Dec. 18, 1978

[51] Int. Cl.[2] ..... A44B 11/20; A44B 11/25

[52] U.S. Cl. ..... 24/206 B; 24/265 WS

[58] Field of Search ..... 24/206 R, 206 B, 265 WS, 24/265 B, 265 BC, 168, 177, 163 R, 74 R, 75, 77 R

[56] References Cited

U.S. PATENT DOCUMENTS

| | | | |
|---|---|---|---|
| 1,606,210 | 11/1926 | Doucette | 24/74 R |
| 3,339,248 | 9/1967 | Campaiola | 24/206 B X |
| 3,349,450 | 10/1967 | Cattin | 24/206 B |
| 3,385,299 | 5/1968 | LeRoy | 24/206 R X |
| 3,557,412 | 1/1971 | Hauser | 24/265 WS X |
| 3,636,596 | 1/1972 | Iizuka | 24/265 WS X |
| 3,706,117 | 12/1972 | Axisa | 24/206 |

*Primary Examiner*—Philip C. Kannan
*Attorney, Agent, or Firm*—Edgar H. Kent

[57] ABSTRACT

In a buckle for joining band ends together, one band end is provided with longitudinally arranged indentations in or adjacent each side edge, and a channel-shaped, adjustable coupling member of the buckle has teeth therein arranged to register with band end indentations at various relative positions and to penetrate the indentations when the band end is pressed against the coupling member. Presser members fixed to the sidewalls of the coupling member press the teeth into engagement with the indentations to maintain the coupling member in adjusted position. The other coupling member may be a cover which releasably engages with the adjustable coupling member.

12 Claims, 17 Drawing Figures

FIG 1
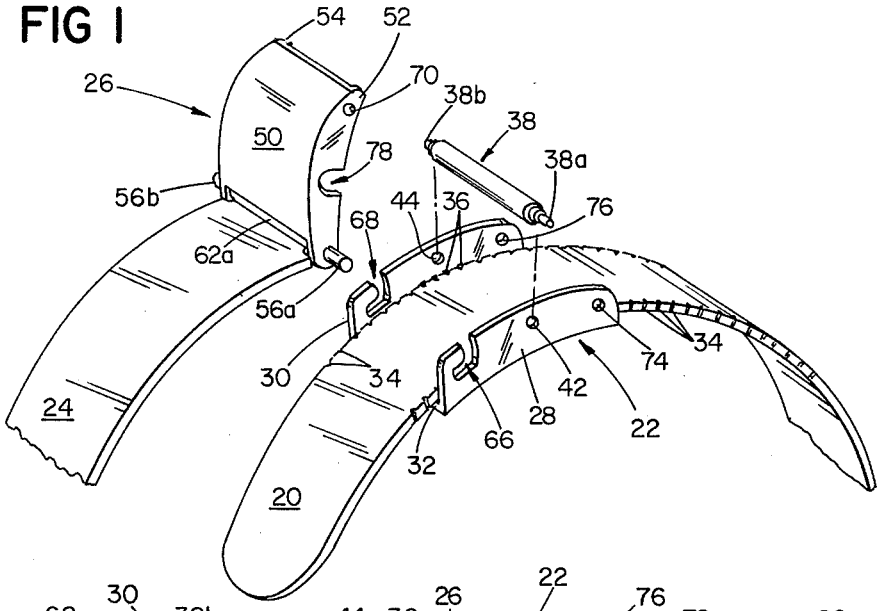
FIG 1a
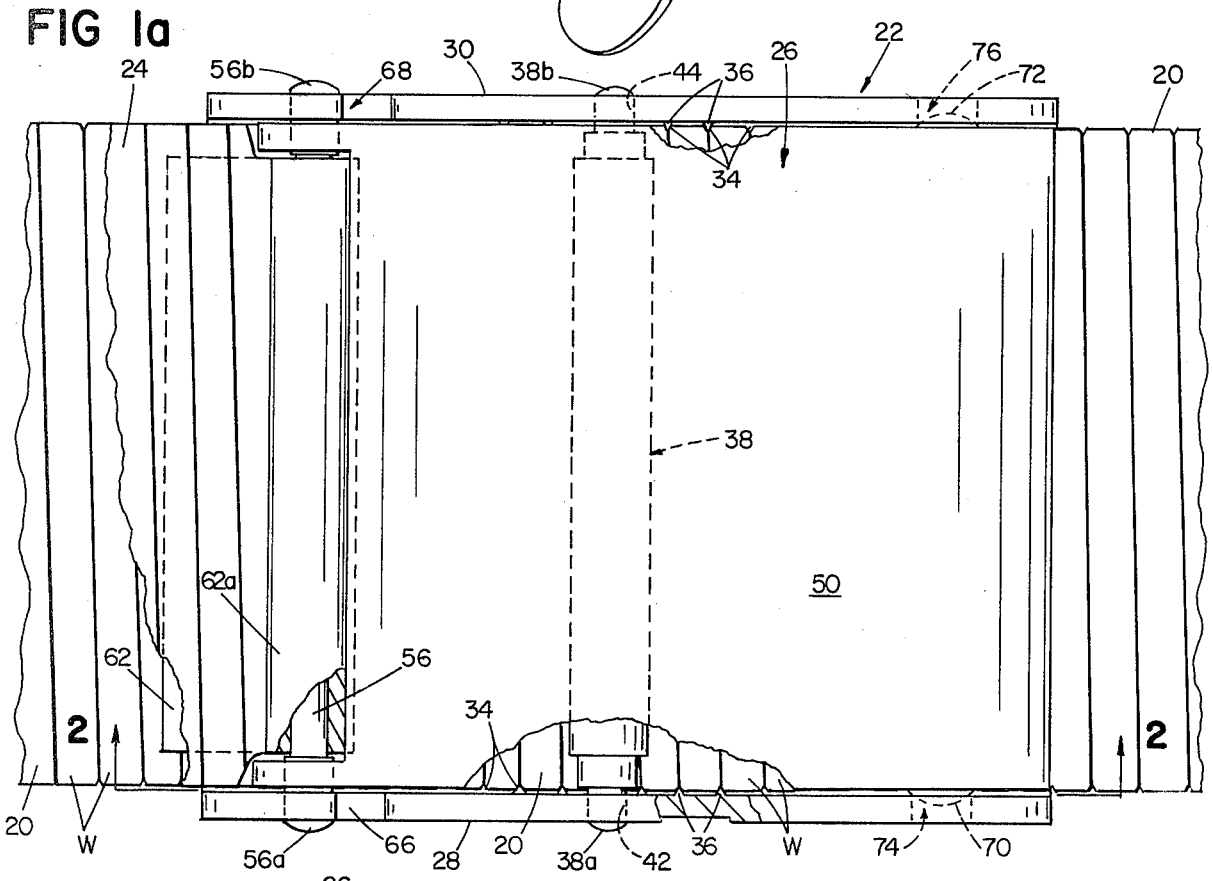
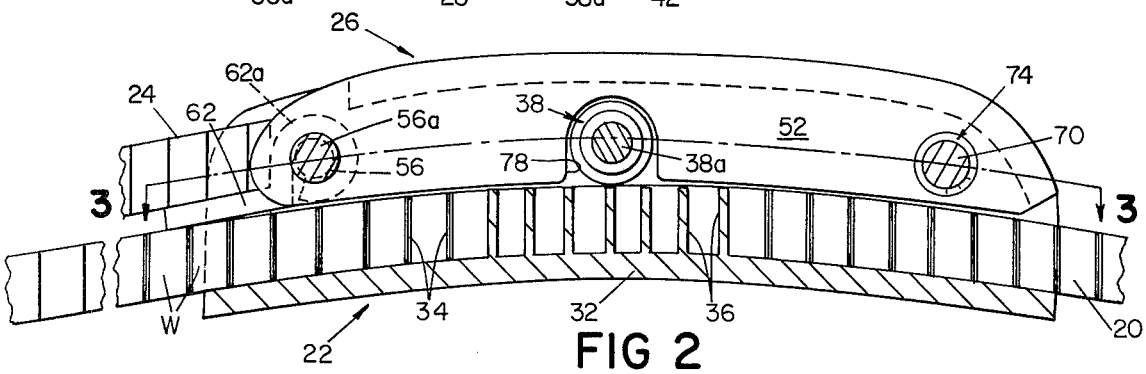
FIG 2

FIG 6
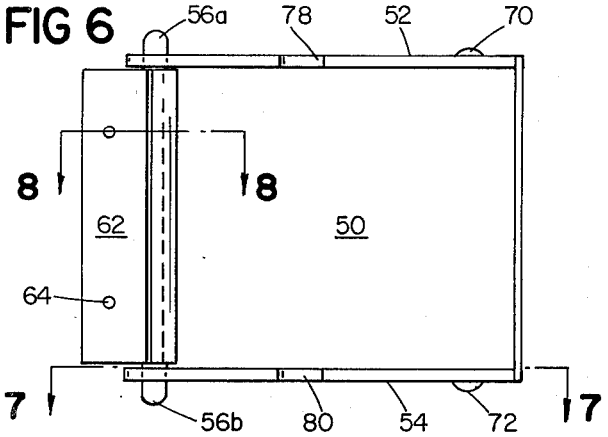
FIG 7
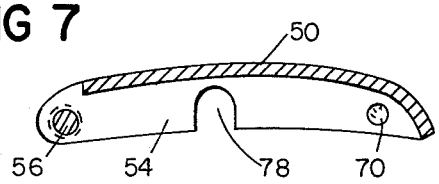
FIG 8
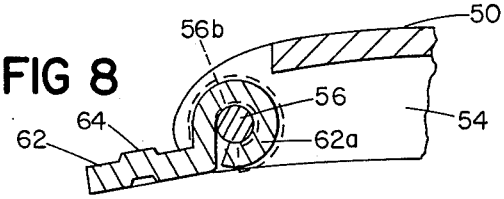
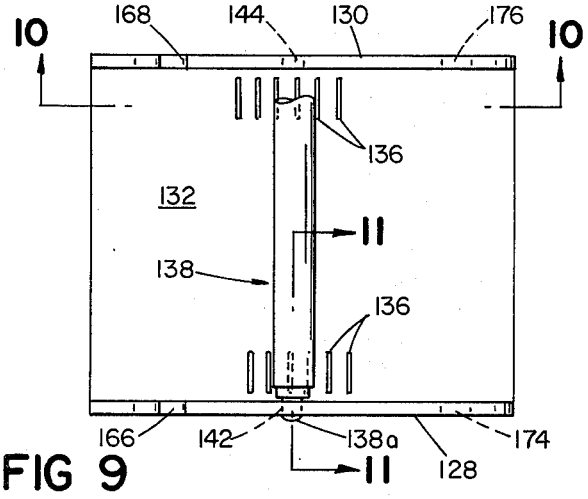
FIG 9
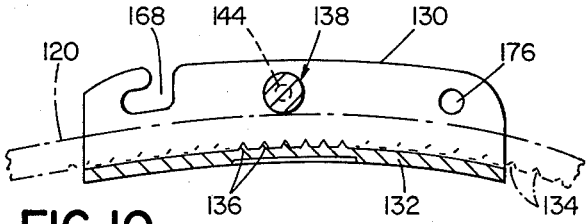
FIG 10
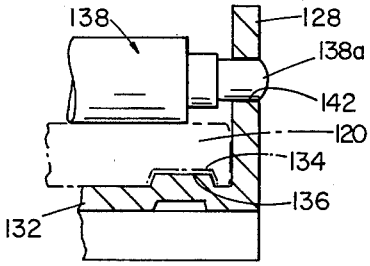
FIG 11
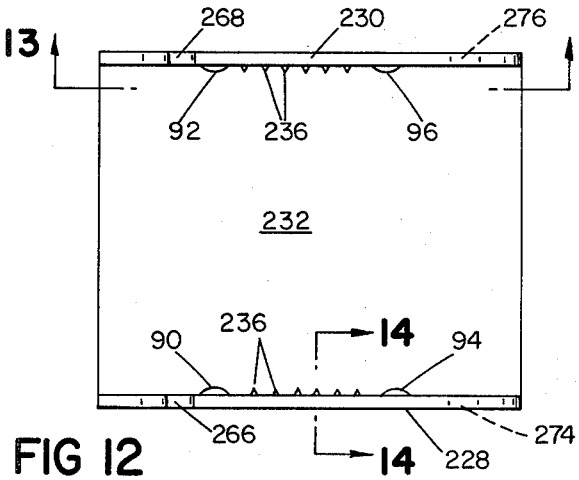
FIG 12
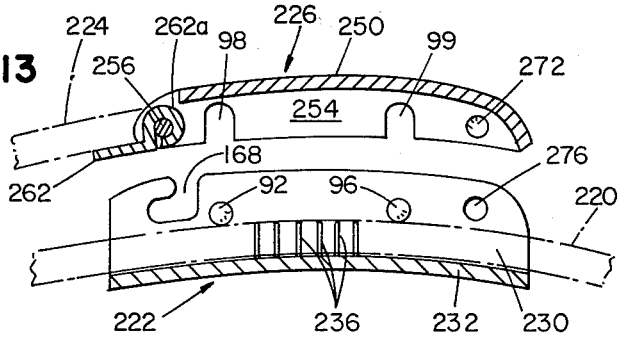
FIG 13
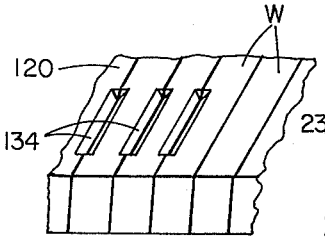
FIG 16
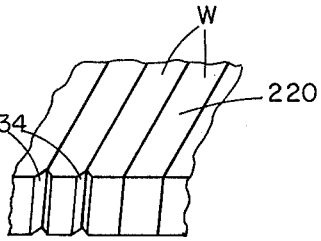
FIG 15
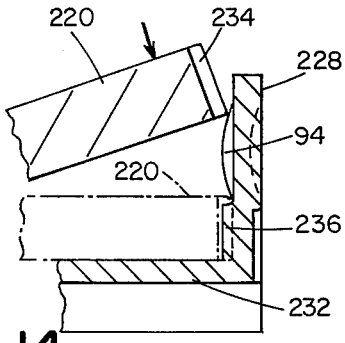
FIG 14

BUCKLE

BACKGROUND OF THE INVENTION

This invention relates to a buckle for joining together the ends of bands or straps to form a bracelet, watchband or the like, particularly such a buckle capable of joining the band ends together with an adjustable amount of overlap.

The conventional hook and eye type buckle used on leather and plastic watchbands has disadvantages, such as unsightly appearance of the row of eyes extending through one band end, reduction of band strength and life by the presence of the eyes and adjustability of overlap for wrist fit only in large increments. Various other buckle structures are available, being used primarily where the band ends are formed of metal, and generally involve two coupling members one of which is non-adjustably fixed to one of the band ends and the other of which is longitudinally adjustably secured to the other band end. Where the band end is of extendable mesh, adjustable positioning of the adjustable coupling member may be obtained by selectively engaging teeth thereon through voids in the mesh. Otherwise it has been a practice to provide indentations on the inside of the band with which teeth on the adjustable member are engaged. In order to press the teeth into adjusted engagement with the respective voids or indentations, releasable pressure applying mechanism is provided in the adjustable member, commonly in the form of a pressure plate and toggle leverage or a rotary cam acting thereon. Such mechanisms have been costly to make and assemble and in some cases difficult for the user to operate in making an adjustment.

SUMMARY OF THE INVENTION

An object of this invention is to provide a buckle with an adjustable position coupling member in which the pressure-applying mechanism for locking the adjustable coupling member in position is simpler and less costly to make and assemble than in aforesaid buckles of the prior art, and which is easy to operate.

Another object is to provide such a buckle which utilizes indentations in the sides of the band end instead of in a face thereof as in the prior art, thereby avoiding deleterious effect of the latter on appearance and improving effectiveness.

A further object is to provide such a buckle which includes a cover member for the adjustable coupling member which is fixed to another band end and is provided with improved locking means cooperating with such means on the adjustable member for releasably locking them together.

In one aspect, the invention provides the combination of a band end having a plurality of indentations in or adjacent each side edge arranged longitudinally thereof, and a coupling member of a buckle mountable in different positions longitudinally of the band end. The coupling member has a channel shape with a bottom wall and opposed sidewalls dimensioned to receive the band end between them with one of its large surfaces engaging the bottom wall. The member has teeth located therein to lie opposite at least some of the indentations at each side of the band end disposed in the member at different relative longitudinal positions, the teeth being dimensioned to penetrate at least some of the indentations when the band end is pressed toward the bottom wall of the coupling member. The coupling member further has a pair of opposite presser members, one fixed to each sidewall in position to press the corresponding edge of the band end toward the bottom wall to engage the teeth in the indentations.

Such arrangement of indentations in the band end and teeth and presser members in the coupling member provides an effective adjustable locking of the coupling member to the band end with simpler, less costly structure than in prior art devices.

In another aspect, the invention provides as its preferred construction, a combination of band end and coupling member of a buckle in which the indentations are in the sides of the band end and the teeth are on the sidewalls of the coupling member. Preferably, the indentations are slots extending through the band edges and the teeth are ridges. Such arrangement of the indentations in the edges of the band end where they are generally not visible avoids disfiguring the band end by indentations in a face thereof as in the prior art and non-preferred construction hereof, and provides for simple, effective position latching of the coupling member relative to the band end.

In one construction according to the invention, presser members are provided as the opposite ends of a bar removably fixed to the sidewalls of the coupling member. To adjust the position of the coupling member along the band end, the bar is removed and reapplied. In an alternative construction, presser members are provided as one pair or preferably two pairs of opposite bosses projecting inwardly from the sidewalls of the coupling member of a length such that the band end can be forced down between them to engage the coupling member teeth in the band end indentations.

The buckle preferably includes a cover member for the previously mentioned coupling member which is secured to a second band end to be joined to the first band end having the previously mentioned coupling member thereon, the cover member and coupling member having cooperating means to releasably maintain the same assembled to join the band ends together. Effective such means are provided by pin ends projecting laterally from one of the members and L-shaped receiving slots in the other.

BRIEF DESCRIPTION OF THE DRAWINGS

In the accompanying drawings:

FIG. 1 is an exploded perspective view of two band ends with attached adjustable and cap coupling members of a buckle according to the invention;

FIG. 1*a* is a top plan view of the coupling members of FIG. 1, assembled to join the band ends together;

FIG. 2 is a cross-section view taken on line 2—2 of FIG. 1*a* looking in the direction of the arrows;

FIG. 6 is a top plan view of assembled parts of the buckle shown in the previous figures, inverted in respect to other Figures;

FIGS. 7 and 8 are cross-section views taken on lines 7—7 and 8—8, respectively, of FIG. 6, looking in the direction of the arrows;

FIG. 9 is a top plan view of a modification of one of the coupling members;

FIG. 10 is a cross-section view taken on line 10—10 of FIG. 9, with band end added;

FIG. 11 is a fragmentary cross section view taken on line 11—11 of FIG. 9;

FIG. 12 is a view similar to FIG. 9 of another modification of one of the coupling members;

FIG. 13 is an exploded view showing in cross-section taken on line 13—13 of FIG. 12 looking in the direction of the arrows the coupling member of FIG. 12 attached to a band end, and also showing in similar view a cap coupling member attached to another band end;

FIG. 14 is a fragmentary cross-section view taken on line 14—14 of FIG. 12 and showing in cross-section a portion of a band end being inserted into the coupling member; and FIGS. 15 and 16 are fragmentary perspective views of two band ends used in previous Figures.

DESCRIPTION OF THE PREFERRED EMBODIMENTS

Referring first to the embodiment shown in FIGS. 1-8, FIG. 1 shows separated a first band end 20 with adjustable coupling member designated generally 22 and a second band end 24 with attached coupling cap member designated generally 26. In FIG. 1 and throughout the drawings the band ends are indicated as formed of helically wound wire of S or Z shaped cross-section interlinked and flattened, in accordance with U.S. Pat. No. 3,469,951 and No. 3,893,319. The resultant band has successive, abutted, transversely extending wire portions W (see FIGS. 1*a* and 2) which are interengaged and flat and form the large and side surfaces, the band being transversely but not longitudinally flexible and non-extendable. Such band material is merely illustrative; since the invention is generally applicable to band materials which have sufficient structural stability to sustain and retain the requisite indentations.

Figure 3:
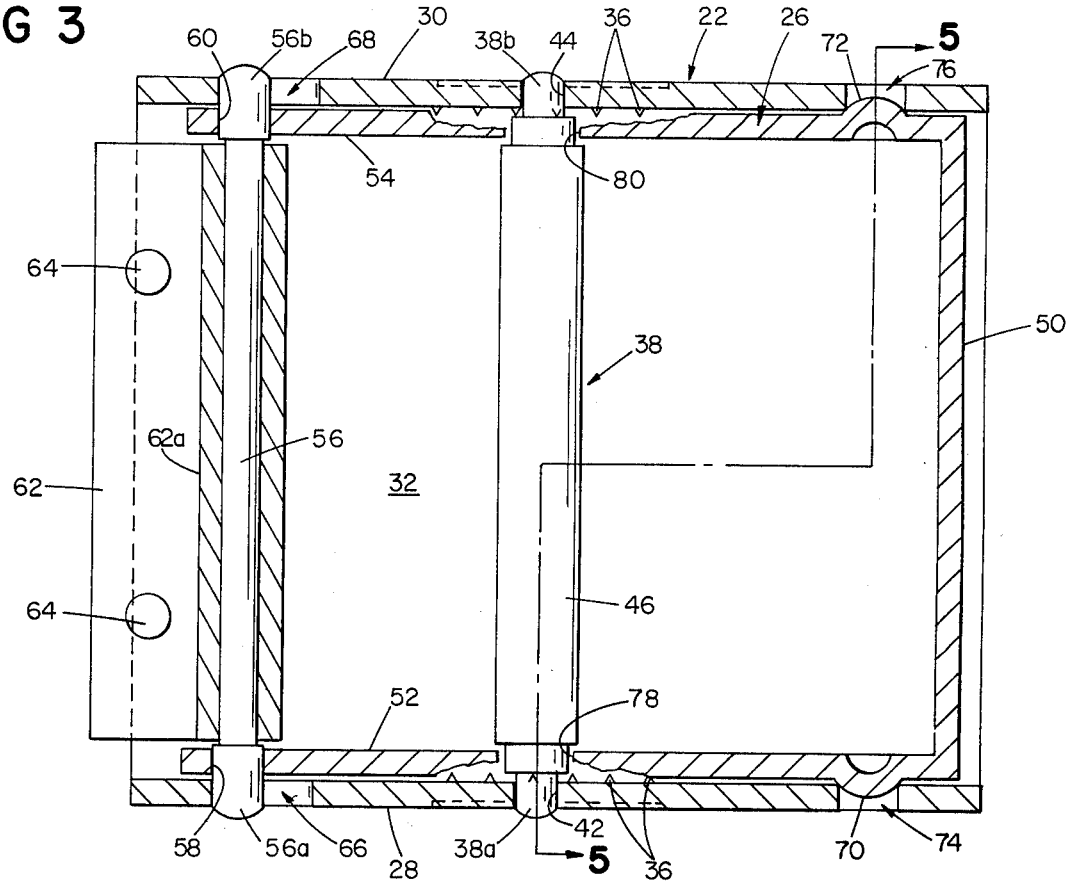
FIG. 3 is a cross-section view of the assembled buckle shown in FIG. 2, taken on line 3—3 of FIG. 2 looking in the direction of the arrows, with one band end omitted.
Figure 4:
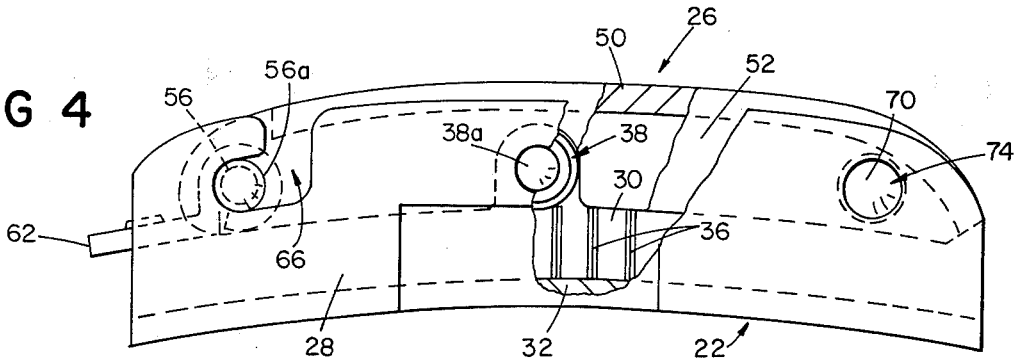
FIG. 4 is a side view, partially broken away and in cross-section, of the buckle shown in FIG. 3.
Figure 5:
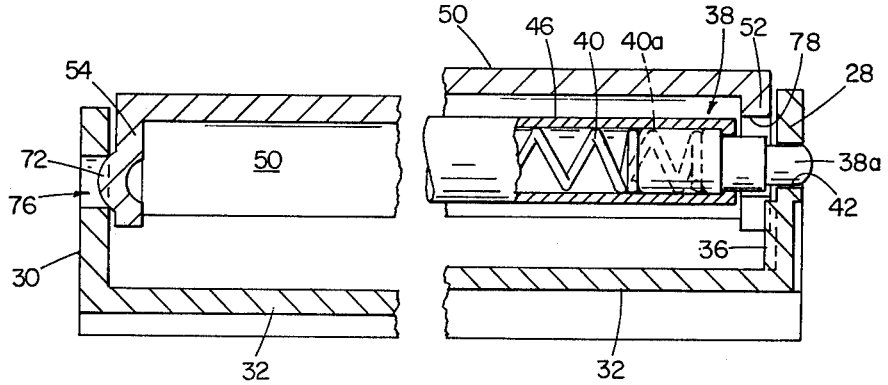
FIG. 5 is a cross-section view taken on line 5—5 of FIG. 3, looking in the direction of the arrows, in part broken away.

Coupling member 22 is of open channel shape, having a pair of opposed sidewalls 28 and 30 and a spanning bottom wall 32, all slightly curved longitudinally to correspond with wrist curvature for forming a watchband of the joined band ends which are attached at their opposite ends to the pintles of a watch (not shown). Formed in each side edge of band end 20, for example, by striking, shaving or machining are a plurality of indentations 34, shown as, and preferably, grooves extending vertically through the band edges so that their ends are open, and of V-shaped cross-section. As shown in FIGS. 1*a*, 2 and 3, each of sidewalls 28 and 30 is provided with a plurality of teeth 36 in the form of opposed ribs projecting from the inner faces of the sidewalls at their base, arranged vertically, of shape and size to fit indentations 34, of approximately the same length as the indentations 34 and having the same centerline spacing. Whereas, a large number of indentations 34 is provided in each edge of band end 20 throughout the length thereof on which it is desired to have coupling member 22 selectively mountable, a relatively small number of the teeth 36 is sufficient to provide the desired retention interlock.

The spacing between the tips of opposed teeth on the sidewalls 28 and 30 is less than the width of band end 20, whereas the spacing between the sidewalls is only slightly greater than the width of band end 20. Thus, the band end may be drawn freely between sidewalls 28 and 30 above the teeth until the desired position of the member relative to the band end is reached, whereupon the band end is pressed toward bottom wall 32 of the member, inserting the teeth endwise into corresponding indentations 34 in the band sides.

To releasably lock the band end and coupling member together with the teeth and indentations interengaged, a spring pin 38 is provided, shown removed for adjustment in FIG. 1, the opposite reduced tips 38*a* and 38*b* of which are pressed inwardly against an internal spring 40 (see FIG. 5) to insert the pin between sidewalls 28 and 30 and released to enter receiving apertures 42, 44, respectively, in the sidewalls. The casing 46 of pin 38 (see FIG. 5) is of a length to fit closely between sidewalls 28 and 30 and of a diameter in relation to mounting apertures 42, 44 such as to bear tightly against the sides of band end 20. The pin 38 may be of conventional commercially available form in which the internal spring 40 extends substantially the full length of casing 46, as indicated by the dashed line extension 40*a* of spring 40 in FIG. 5, which bears against thin enlargements of the base of the outwardly pressed pin tips 38*a* and 38*b*. However, since the end portions of the pin casing 46 constitute presser members for pressing the sides of band end 20 against base 32, it is preferred that they be made stronger by shortening the spring 40 to its length shown in full lines in FIG. 5 and enlarging the solid base of the pin tips accordingly, again as shown in full lines in FIG. 5.

Coupling cap member 26 has a longitudinally curved top wall 50 and opposite sidewalls 52, 54 which are longitudinally curved at the top corresponding to the curvature of wall 50 and at the bottom corresponding to the longitudinal curvature of bottom wall 32 of coupling member 22. The width of the cap member formed by walls 50, 52, 54 is such as to fit closely but freely between sidewalls 28 and 30 of coupling member 22; its length is approximately the same as that of member 22.

Member 26 is pivotally mounted on a hinge pin 56 by means of apertures 58 and 60 in the rear ends of sidewalls 52 and 54 which relatively rotatably receive enlarged end portions 56*a* and 56*b* of pin 56. Pin 56 is non-rotatably mounted on a plate 62 (see FIGS. 2, 3, 6 and 8) one end 62*a* of which is machine rolled tightly around the reduced portion of pin 56 between ends 56*a* and 56*b* after pin 56 ends 56*a* and 56*b* have been inserted through apertures 58 and 60 in sidewalls 52, 54 so that plate 62 and pin 56 are locked together and the pin ends 56*a* and 56*b* are locked in position in apertures 58 and 60, respectively. The flat end of plate 62 is welded to the underside of the tip of band end 24 by spot welds 64.

To join the two coupling members of the buckle together the invention utilizes the enlarged projecting ends 56*a* and 56*b* of the hinge bar 56 of member 26, which are received in L-shaped slots 66, 68 in the outer ends of sidewalls 28 and 30 of member 22, the bottom part of the slots being directed outwardly so that, when the ends 56*a* and 56*b* are seated in the slots, accidental uncoupling is avoided while the band ends are under tension on the wrist. In addition, pressed-out dimples 70, 72 in the opposite ends of sidewalls 52 and 54 are received in corresponding apertures 74, 76 (which may alternatively be depressions) in the corresponding ends of sidewalls 28 and 30 of member 22 when the cover is pivoted on its hinge to closed position. Slots 78 and 80 in the sidewalls 52 and 54 of member 26 permit the cover when closed or opened to pass freely over pin 38 of member 22. It should be noted that the arrangement provides coupling without the need for any extra parts, utilizing parts already present for the purpose and thereby simplifying and reducing cost of the buckle.

In use, adjustable coupling member 22 is normally maintained in pre-adjusted position on band end 20 by pin 38. Should change be desired, it is only necessary to remove pin 38 by depressing with a sharp point one of its tips 38*a* or 38*b* to remove it, lift band end 20 out of mutual engagement of teeth 36 with indentations 34, move the parts to the desired new relative position, press the band end toward bottom wall 32 of member 22 to re-engage the teeth in band indentations and re-insert pin 38. To couple the band ends together, hinge pin ends 56*a* and 56*b* of member 26 are inserted in slots 66, 68 and the cover formed by walls 50, 52 and 54 is closed between sidewalls 28 and 30 of member 22 until dimples 70, 72 engage in apertures 74, 76, the reverse procedure being followed for uncoupling.

FIGS. 9–11 and 16 show a possible, although generally less desirable, alternative structure of band end 20 and adjustable coupling member 22. In these Figures parts corresponding to those of the previous Figures have the same reference numerals preceded by the number 1 (i.e., plus 100). As will be seen, the only difference is that the depressions 134 in band end 120 are located in its flat undersurface adjacent its edges and teeth 136 are located in bottom wall 132 of member 122, adjacent sidewalls 128 and 130 thereof. Adjustable positioning of member 122 on band end 120 is accomplished as in the case of the previously described embodiment with pin 138 removed by moving the parts to desired relative position, pressing band end 120 against bottom wall 132 to engage its teeth 136 in band end depressions 134 and inserting the pin 138 in locking position as shown. Coupling member 26 (not shown) of the previous Figures is unchanged and is assembled to coupling member 122 in the same manner.

FIGS. 12–15 show another modification in which the pin 38 or 138 of previously described embodiments is replaced by simpler structure useful with band end materials, such as that contemplated in the drawings, which are inherently resistant to longitudinal buckling which would draw the side edges toward each other. In this embodiment, parts corresponding to those of FIGS. 1–8 have the same reference numerals preceded by the number 2 (i.e., plus 200). It will be seen that the only difference is that pin 38 has been replaced by four dimples or bosses pressed outwardly from the inner surface of sidewalls 228 and 230 of coupling member 222, arranged as two pairs of opposed presser members 90, 92 and 94, 96 located fore and aft of the teeth 236 on these sidewalls. The bosses are resilient so that with the coupling member 222 in desired location relative to band end 220, each edge of the band end may be pressed down to bottom wall 232 to engage teeth 236 on sidewalls 228 and 230 in depressions 234 in the band sides, as shown in FIG. 14, the bosses yielding to permit the insertion, then restoring to provide retaining pressure. While one pair of bosses centrally located relative to the teeth could be used instead of the two pairs located as shown, the latter is preferred as providing a more secure locking together of the parts.

The coupling cover member 224 of this embodiment is the same as in the others except that centrally located slots 78 and 80 in the sidewalls to receive pin 38 or 138 are replaced by two similar slots in each sidewall spaced apart in locations to receive therein the dimples 90–96 when the cover is closed. The pair of these slots 98 and 99 in sidewall 254 is shown in FIG. 13.

I claim:

1. The combination of a first band end and a coupling member of a buckle mountable in different positions longitudinally of said band end to receive a second band end therein for coupling said ends together, said first band end having a plurality of indentations at each side edge arranged longitudinally thereof, said member having a channel shape with a bottom wall and opposed sidewalls dimensioned to receive therebetween a portion of said first band end with one of its large surfaces engaging said bottom wall, said member having teeth located therein to lie opposite at least some of said indentations at each side of said first band end disposed therein at different relative longitudinal positions and dimensioned to penetrate at least some of said indentations when said first band end is pressed toward said bottom wall, and a pair of opposite presser members one fixed to each said sidewall in position to press the corresponding edge of said first band end toward said bottom wall to engage said teeth in said indentations.

2. The combination of claim 1 wherein said presser members are the opposite ends of a spring pin removably fixed at opposite ends to said side walls.

3. The combination of claim 1 wherein said presser members comprise a pair of resilient bosses of a length such that the band can be forced between them onto said bottom wall.

4. The combination of claim 3 which includes an additional pair of said bosses, each pair of bosses being fixed to the respective sidewalls adjacent opposite ends of the toothed portion of said coupling member.

5. The combination according to any of claims 1 to 4 wherein said indentations are in the side edges of said first band end and said teeth are on said sidewalls of said coupling member.

6. The combination according to claim 5 wherein said indentations are grooves extending through the edge of the band end and said teeth are ridges.

7. The combination according to any of claims 1 to 4 which also includes a second band end and a cover member of said buckle secured to said second band end, said cover member and said coupling member having cooperating means to releasably maintain the same assembled to join said band ends together.

8. The combination according to claim 7 wherein said cooperating means comprise pin ends projecting laterally from one of said cover and coupling members and L-shaped receiving slots in the sides of the other of said members having an open-ended branch for receiving a said pin end and a closed end branch extending laterally therefrom for retaining said pin end therein.

9. The combination according to claim 8 wherein said cover member is hinged to said second band end about a hinge pin having an axis transverse to said second band end and the ends of said pin are said pin ends.

10. The combination of a first band end and a coupling member of a buckle mountable in different positions longitudinally of said first band end to receive a second band end therein for coupling said ends together, said first band end having a plurality of indentations in each side edge thereof, said coupling member having sidewalls between which said first band end is received and teeth on said side walls dimensioned and located to penetrate at least some of said indentations to releasably secure said coupling member to said first band end.

11. The combination according to claim 10 wherein said indentations are grooves extending through said side edges and said teeth are ridges.

12. The combination according to claim 11 wherein said coupling member includes a bottom wall spanning said sidewalls and means for releasably pressing said first band end against said bottom wall to maintain said teeth in said grooves.

* * * * *